US006669743B2

(12) United States Patent
Wittenbrink et al.

(10) Patent No.: US 6,669,743 B2
(45) **Date of Patent: *Dec. 30, 2003**

(54) SYNTHETIC JET FUEL AND PROCESS FOR ITS PRODUCTION (LAW724)

(75) Inventors: Robert J. Wittenbrink, Baton Rouge, LA (US); Paul J Berlowitz, E. Windsor, NJ (US); Bruce R. Cook, Pittstown, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/794,939

(22) Filed: Feb. 27, 2001

(65) Prior Publication Data

US 2002/0005009 A1 Jan. 17, 2002

Related U.S. Application Data

(63) Continuation of application No. 09/098,231, filed on Jun. 16, 1998, now Pat. No. 6,309,432, which is a continuation-in-part of application No. 08/798,378, filed on Feb. 7, 1997, now Pat. No. 5,766,274.

(51) Int. Cl.[7] ..... C10L 1/18

(52) U.S. Cl. ..... 44/436; 44/452; 208/15; 208/137; 208/141; 208/950

(58) Field of Search ..... 44/436, 452; 208/15, 208/950, 137, 141

(56) References Cited

U.S. PATENT DOCUMENTS

| | | | | |
|---|---|---|---|---|
| 2,243,760 | A | 5/1941 | Martin | 44/9 |
| 2,562,980 | A | 8/1951 | Atwell | 260/450 |
| 2,668,790 | A | 2/1954 | Good et al. | 196/50 |
| 2,668,866 | A | 2/1954 | Good et al. | 260/683.5 |
| 2,756,183 | A | 7/1956 | Knox, Jr. | 196/35 |
| 2,779,713 | A | 1/1957 | Cole et al. | 196/35 |

(List continued on next page.)

FOREIGN PATENT DOCUMENTS

| | | | | |
|---|---|---|---|---|
| AU | 275062 | | 7/1964 | |
| CA | 539698 | | 4/1957 | |
| CA | 700237 | | 12/1964 | |
| CA | 954058 | | 9/1974 | 196/54 |
| DE | 2251156 | | 4/1973 | |
| DE | 3030998 | A1 | 4/1982 | |
| DE | P30309989 | | 4/1982 | C10G/1/06 |
| EP | 0113045 | A1 | 7/1984 | C10M/1/48 |
| EP | 0153782 | | 9/1985 | B01J/37/26 |
| EP | 0227218 | A1 | 1/1987 | C10L/1/18 |
| EP | 0266898 | A2 | 5/1988 | B01J/23/74 |
| EP | 0281992 | A3 | 9/1988 | C10M/101/02 |
| EP | 0323092 | | 12/1988 | |
| EP | 0321301 | A3 | 6/1989 | B01J/23/40 |
| EP | 0418860 | A1 | 3/1991 | C10M/169/04 |
| EP | 0374461 | B1 | 5/1992 | C10L/1/14 |
| EP | 0515256 | A1 | 11/1992 | |

(List continued on next page.)

OTHER PUBLICATIONS

Ward, "Compos. Of F–T Diesel Fuel", Div. Pet. Chem. 117th Mtg. ACS (1950).

(List continued on next page.)

*Primary Examiner*—Jacqueline V. Howard
(74) *Attorney, Agent, or Firm*—Linda M. Scuorzo; Mark D. Marin

(57) ABSTRACT

Clean distillate useful as a jet fuel or jet blending stock is produced from Fischer-Tropsch wax by separating wax into heavier and lighter fractions; further separating the lighter fraction and hydroisomerizing the heavier fraction and that portion of the light fraction above about 475° F. The isomerized product is blended with the untreated portion of the lighter fraction to produce high quality, clean, jet fuel.

7 Claims, 1 Drawing Sheet

U.S. PATENT DOCUMENTS

| | | | | |
|---|---|---|---|---|
| 2,817,693 | A | 12/1957 | Koome et al. | 260/683.5 |
| 2,838,444 | A | 6/1958 | Teter et al. | 196/50 |
| 2,888,501 | A | 5/1959 | Folkins et al. | 260/683.65 |
| 2,892,003 | A | 6/1959 | Weisz | 260/683.65 |
| 2,906,688 | A | 9/1959 | Farmer et al. | 208/33 |
| 2,914,464 | A | 11/1959 | Burton et al. | 208/138 |
| 2,982,802 | A | 5/1961 | Folkins et al. | 260/683.65 |
| 2,993,938 | A | 7/1961 | Bloch et al. | 260/666 |
| 3,002,827 | A | 10/1961 | Fenske | |
| 3,052,622 | A | 9/1962 | Johnson et al. | 208/27 |
| 3,078,323 | A | 2/1963 | Kline et al. | 260/683.65 |
| 3,121,696 | A | 2/1964 | Hoekstra | 252/441 |
| 3,123,573 | A | 3/1964 | Carr | 252/442 |
| 3,125,511 | A | 3/1964 | Tupman et al. | 208/264 |
| 3,147,210 | A | 9/1964 | Hass et al. | 208/210 |
| 3,188,286 | A | 6/1965 | Van Driesen | 208/108 |
| 3,206,525 | A | 9/1965 | Michaels et al. | 260/683.66 |
| 3,253,055 | A | 5/1966 | Goble et al. | 260/683.75 |
| 3,268,436 | A | 8/1966 | Arey, Jr. et al. | 208/59 |
| 3,268,439 | A | 8/1966 | Tupman et al. | 208/112 |
| 3,308,052 | A | 3/1967 | Ireland et al. | 208/27 |
| 3,338,843 | A | 8/1967 | Goble et al. | 252/442 |
| 3,340,180 | A | 9/1967 | Beuther et al. | 208/108 |
| 3,365,390 | A | 1/1968 | Egan et al. | 208/60 |
| 3,395,981 | A | 8/1968 | Kischio | |
| 3,404,086 | A | 10/1968 | Plank et al. | 208/120 |
| 3,471,399 | A | 10/1969 | O'Hara | 208/216 |
| 3,486,993 | A | 12/1969 | Egan et al. | 208/89 |
| 3,487,005 | A | 12/1969 | Egan et al. | 208/59 |
| 3,507,776 | A | 4/1970 | Hann | 208/85 |
| 3,530,061 | A | 9/1970 | Orkin et al. | 208/60 |
| 3,594,307 | A | 7/1971 | Kirk, Jr. | 208/57 |
| 3,607,729 | A | 9/1971 | Robinson et al. | 208/112 |
| 3,619,408 | A | 11/1971 | Larson | 208/80 |
| 3,620,960 | A | 11/1971 | Kozlowski et al. | 208/60 |
| 3,629,096 | A | 12/1971 | Divijak, Jr. | 208/89 |
| 3,630,885 | A | 12/1971 | Egan | 208/59 |
| 3,658,689 | A | 4/1972 | Steinmetz et al. | 208/46 |
| 3,660,058 | A | 5/1972 | Feldman et al. | 44/80 |
| 3,668,112 | A | 6/1972 | Parker | |
| 3,668,113 | A | 6/1972 | Burbidge | |
| 3,674,681 | A | 7/1972 | Lyon | 208/141 |
| 3,681,232 | A | 8/1972 | Egan | 208/80 |
| 3,684,695 | A | 8/1972 | Neel et al. | 208/110 |
| 3,692,695 | A | 9/1972 | Suggitt et al. | 252/439 |
| 3,692,697 | A | 9/1972 | Kravitz et al. | 252/439 |
| 3,711,399 | A | 1/1973 | Estes et al. | 208/112 |
| 3,717,586 | A | 2/1973 | Suggitt et al. | 252/439 |
| 3,725,302 | A | 4/1973 | Shimely | 252/431 R |
| 3,709,817 | A | 6/1973 | Suggitt et al. | 208/112 |
| 3,761,388 | A | 9/1973 | Bryson et al. | 208/59 |
| 3,767,562 | A | 10/1973 | Sze et al. | 208/57 |
| 3,770,618 | A | 11/1973 | Adams | 208/216 |
| 3,775,291 | A | 11/1973 | Sze | 208/57 |
| 3,794,580 | A | 2/1974 | Ladeur | 208/110 |
| 3,814,682 | A | 6/1974 | Christman et al. | 208/216 |
| 3,830,723 | A | 8/1974 | Ladeur et al. | 208/108 |
| 3,830,728 | A | 8/1974 | Mounce | 208/59 |
| 3,840,508 | A | 10/1974 | Ballard et al. | 260/88.2 R |
| 3,840,614 | A | 10/1974 | Kravitz et al. | 260/683.68 |
| 3,843,509 | A | 10/1974 | Suto et al. | 208/111 |
| 3,843,746 | A | 10/1974 | Kravitz et al. | 260/683.68 |
| 3,848,018 | A | 11/1974 | Robson | 260/683.65 |
| 3,852,186 | A | 12/1974 | Christman et al. | 208/89 |
| 3,852,207 | A | 12/1974 | Stangeland et al. | 208/58 |
| 3,861,005 | A | 1/1975 | Steinmetz et al. | 208/111 |
| 3,864,425 | A | 2/1975 | Gardner | 260/683.68 |
| 3,870,622 | A | 3/1975 | Ashton et al. | 208/93 |
| 3,876,522 | A | 4/1975 | Campbell et al. | 208/58 |
| 3,887,455 | A | 6/1975 | Hamner | 208/112 |
| 3,915,843 | A | 10/1975 | Franck et al. | 208/112 |
| 3,963,601 | A | 6/1976 | Hilfman | 208/111 |
| 3,976,560 | A | 8/1976 | Erickson | 208/138 |
| 3,977,961 | A | 8/1976 | Hamner | 208/59 |
| 3,977,962 | A | 8/1976 | Arey, Jr. et al. | 208/59 |
| 3,979,279 | A | 9/1976 | Yan | 208/264 |
| 4,014,821 | A | 3/1977 | Hamner | 252/470 |
| 4,032,304 | A | 6/1977 | Dorer, Jr. et al. | 44/70 |
| 4,032,474 | A | 6/1977 | Goudriaan et al. | 252/441 |
| 4,041,095 | A | 8/1977 | Kuo | 260/676 |
| 4,051,021 | A | 9/1977 | Hamner | 208/216 |
| 4,059,648 | A | 11/1977 | Derr et al. | 260/676 R |
| 4,067,797 | A | 1/1978 | Chen | 208/15 |
| 4,073,718 | A | 2/1978 | Hamner | 208/80 |
| 4,079,025 | A | 3/1978 | Young et al. | 260/17.4 GC |
| 4,087,349 | A | 5/1978 | Baird, Jr. | |
| 4,125,566 | A | 11/1978 | Dinh | 260/676 |
| 4,139,494 | A | 2/1979 | Itoh et al. | 252/455 R |
| 4,162,962 | A | 7/1979 | Stangeland | 208/58 |
| 4,186,078 | A | 1/1980 | Itoh et al. | 208/27 |
| 4,212,771 | A | 7/1980 | Hamner | 252/455 Z |
| 4,263,127 | A | 4/1981 | Rausch et al. | 208/58 |
| 4,304,871 | A | 12/1981 | Brennan et al. | 518/717 |
| 4,342,641 | A | 8/1982 | Reif et al. | 208/89 |
| 4,378,973 | A | 4/1983 | Sweeney | 44/56 |
| 4,390,414 | A | 6/1983 | Cody | 208/111 |
| 4,392,940 | A | 7/1983 | Tao | 208/8 LE |
| 4,394,251 | A | 7/1983 | Miller | 208/111 |
| 4,427,534 | A | 1/1984 | Brunn et al. | 208/89 |
| 4,427,791 | A | 1/1984 | Miale | 502/203 |
| 4,428,819 | A | 1/1984 | Shu et al. | 208/46 |
| 4,444,895 | A | 4/1984 | Fung et al. | 502/37 |
| 4,451,572 | A | 5/1984 | Cody | 502/62 |
| 4,472,529 | A | 9/1984 | Johnson et al. | 502/228 |
| 4,477,586 | A | 10/1984 | McDaniel | 502/104 |
| 4,487,688 | A | 12/1984 | Dessau | 208/310 Z |
| 4,518,395 | A | 5/1985 | Petronella | 44/53 |
| 4,527,995 | A | 7/1985 | Itow et al. | 44/56 |
| 4,529,526 | A | 7/1985 | Inoue et al. | 252/32.7 E |
| 4,539,014 | A | 9/1985 | Sweeney | 44/56 |
| 4,568,663 | A | 2/1986 | Mauldin | 502/325 |
| 4,579,986 | A | 4/1986 | Sie | 585/324 |
| 4,588,701 | A | 5/1986 | Chiang | 502/65 |
| 4,594,172 | A | 6/1986 | Sie | 252/55 |
| 4,599,162 | A | 7/1986 | Yen | 208/59 |
| 4,608,151 | A | 8/1986 | Miller | 208/33 |
| 4,618,412 | A | 10/1986 | Hudson et al. | 208/59 |
| 4,627,908 | A | 12/1986 | Miller | 208/58 |
| 4,645,585 | A | 2/1987 | White | 208/58 |
| 4,673,487 | A | 6/1987 | Miller | 208/58 |
| 4,684,756 | A | 8/1987 | Derr, Jr. et al. | 585/330 |
| 4,695,365 | A | 9/1987 | Ackelson et al. | 208/89 |
| 4,749,467 | A | 6/1988 | Chen et al. | 208/59 |
| 4,755,280 | A | 7/1988 | Hudson et al. | 208/89 |
| 4,764,266 | A | 8/1988 | Chen et al. | 208/58 |
| 4,804,802 | A | 2/1989 | Evans | 587/734 |
| 4,832,819 | A | 5/1989 | Hamner | 208/27 |
| 4,851,109 | A | 7/1989 | Chen et al. | 208/58 |
| 4,855,530 | A | 8/1989 | LaPierre et al. | 585/739 |
| 4,863,887 | A | 9/1989 | Ohtake et al. | 502/150 |
| 4,875,992 | A | 10/1989 | Hamner | 208/89 |
| 4,900,707 | A | 2/1990 | Cody et al. | 502/230 |
| 4,906,599 | A | 3/1990 | Cody et al. | 502/62 |
| 4,910,227 | A | 3/1990 | Brown et al. | 518/700 |
| 4,911,821 | A | 3/1990 | Katzer et al. | 208/27 |
| 4,919,786 | A | 4/1990 | Hamner | 208/27 |
| 4,919,788 | A | 4/1990 | Chen et al. | 208/59 |
| 4,923,841 | A | 5/1990 | Hamner | 502/230 |
| 4,929,795 | A | 5/1990 | Cody et al. | 585/739 |
| 4,935,120 | A | 6/1990 | Lipinski et al. | 208/59 |
| 4,937,399 | A | 6/1990 | Wachter et al. | 585/749 |

| | | | | | |
|---|---|---|---|---|---|
| 4,943,672 | A | | 7/1990 | Hamner | 585/737 |
| 4,959,337 | A | | 9/1990 | Cody et al. | 502/230 |
| 4,960,504 | A | | 10/1990 | Pellet | 208/411 |
| 4,962,269 | A | | 10/1990 | LaPierre et al. | 585/739 |
| 4,982,031 | A | | 1/1991 | Chen | 208/324 |
| 4,990,713 | A | | 2/1991 | Le et al. | 585/332 |
| 4,992,159 | A | | 2/1991 | Cody | 585/734 |
| 4,992,406 | A | | 2/1991 | Mauldin | 502/325 |
| 5,015,361 | A | | 5/1991 | Anthes et al. | 208/111 |
| 5,037,528 | A | | 8/1991 | Garwood et al. | 208/27 |
| 5,059,299 | A | | 10/1991 | Cody | 585/737 |
| 5,059,741 | A | | 10/1991 | Foley | 585/734 |
| 5,075,269 | A | | 12/1991 | Degnan et al. | 502/77 |
| 5,110,445 | A | | 5/1992 | Chen et al. | 208/505 |
| 5,120,425 | A | | 6/1992 | Zones et al. | 208/46 |
| 5,128,377 | A | | 7/1992 | Behrmann et al. | 518/715 |
| 5,156,114 | A | | 10/1992 | Gunnerman | |
| 5,157,187 | A | | 10/1992 | Le et al. | 585/208 |
| 5,158,671 | A | | 10/1992 | Cody et al. | 208/264 |
| 5,183,556 | A | | 2/1993 | Reilly et al. | 208/57 |
| 5,187,138 | A | | 2/1993 | Davis | 502/255 |
| 5,210,347 | A | | 5/1993 | Chen et al. | 585/14 |
| 5,281,347 | A | | 1/1994 | Igarashi et al. | 252/42.7 |
| 5,282,958 | A | | 2/1994 | Santilli et al. | 208/585 |
| 5,292,988 | A | | 3/1994 | Wu | 585/741 |
| 5,292,989 | A | | 3/1994 | Davis | 585/751 |
| 5,300,212 | A | | 4/1994 | Winter | 208/67 |
| 5,302,279 | A | | 4/1994 | Degnan et al. | 208/87 |
| 5,306,860 | A | | 4/1994 | Bigeard et al. | 585/737 |
| 5,308,365 | A | | 5/1994 | Kesling | 44/447 |
| 5,324,335 | A | | 6/1994 | Benham | 44/452 |
| 5,345,019 | A | | 9/1994 | Bigeard | |
| 5,348,982 | A | | 9/1994 | Herbolzheimer et al. | 518/700 |
| 5,362,378 | A | | 11/1994 | Borghard et al. | 208/138 |
| 5,370,788 | A | | 12/1994 | Dai | |
| 5,378,249 | A | | 1/1995 | Morrison | 44/388 |
| 5,378,348 | A | | 1/1995 | Davis et al. | 208/27 |
| 5,378,351 | A | | 1/1995 | Guichard et al. | 208/143 |
| 5,385,588 | A | | 1/1995 | Brennan | 44/331 |
| 5,466,362 | A | | 11/1995 | Steinberg et al. | 208/157 |
| 5,479,775 | A | | 1/1996 | Kraemer et al. | 60/274 |
| 5,500,449 | A | | 3/1996 | Benham et al. | 518/700 |
| 5,504,118 | A | | 4/1996 | Benham et al. | 518/719 |
| 5,506,272 | A | | 4/1996 | Benham et al. | 518/700 |
| 5,522,983 | A | | 6/1996 | Cash et al. | 208/59 |
| 5,527,473 | A | | 6/1996 | Ackerman | 210/767 |
| 5,538,522 | A | | 7/1996 | Ahmed | 44/412 |
| 5,543,437 | A | | 8/1996 | Benham et al. | 518/700 |
| 5,545,674 | A | | 8/1996 | Behrmann et al. | 518/715 |
| 5,689,031 | A | * | 11/1997 | Berlowitz et al. | 585/34 |
| 5,766,274 | A | * | 6/1998 | Wittenbrink et al. | 44/436 |
| 5,807,413 | A | | 9/1998 | Wittenbrink et al. | 44/451 |
| 5,814,109 | A | | 9/1998 | Cook et al. | 44/300 |
| 5,833,839 | A | | 11/1998 | Wittenbrink et al. | 208/112 |
| 5,866,748 | A | | 2/1999 | Wittenbrink et al. | 585/734 |
| 6,017,372 | A | * | 1/2000 | Berlowitz et al. | 44/451 |
| 6,080,301 | A | | 6/2000 | Berlowitz et al. | 208/18 |
| 6,162,956 | A | | 12/2000 | Berlowitz et al. | 585/14 |
| 6,165,949 | A | | 12/2000 | Berlowitz et al. | 508/363 |
| 6,168,768 | B1 | | 1/2001 | Alexion et al. | 423/210 |
| 6,180,842 | B1 | | 1/2001 | Berlowitz et al. | 585/1 |
| RE37,229 | E | | 6/2001 | Behrmann et al. | 585/899 |
| 6,274,029 | B1 | * | 8/2001 | Wittenbrink et al. | 208/15 |
| RE37,406 | E | | 10/2001 | Behrmann et al. | 518/715 |
| 6,296,757 | B1 | | 10/2001 | Wittenbrink et al. | 208/15 |
| 6,309,432 | B1 | | 10/2001 | Wittenbrink et al. | 44/436 |

FOREIGN PATENT DOCUMENTS

| | | | | |
|---|---|---|---|---|
| EP | 0515270 | A1 | 11/1992 | |
| EP | 0532117 | A1 | 3/1993 | |
| EP | 0532118 | A1 | 3/1993 | |
| EP | 0441014 | B1 | 4/1993 | C10L/1/22 |
| EP | 0542528 | A1 | 5/1993 | |
| EP | 0555006 | A1 | 8/1993 | C10L/1/22 |
| EP | 0566348 | A2 | 10/1993 | |
| EP | 0587245 | A1 | 3/1994 | |
| EP | 0587246 | A1 | 3/1994 | |
| EP | 0634472 | A1 | 1/1995 | C10L/1/14 |
| EP | 0460957 | B1 | 2/1995 | C10L/1/14 |
| EP | 0668342 | A1 | 8/1995 | |
| EP | 0753563 | A1 | 1/1997 | |
| EP | 0569228 | B1 | 6/1998 | C10L/1/14 |
| FR | 732964 | | 3/1932 | |
| FR | 859686 | | 8/1939 | |
| FR | 2137490 | | 4/1972 | |
| FR | 2650289 | | 2/1991 | C10L/1/18 |
| GB | 728543 | | 4/1955 | |
| GB | 823010 | | 11/1959 | |
| GB | 848198 | | 9/1960 | |
| GB | 951997 | | 3/1964 | |
| GB | 953188 | | 3/1964 | |
| GB | 953189 | | 3/1964 | |
| GB | 1065205 | | 4/1967 | |
| GB | 1306646 | | 2/1973 | C10G/21/16 |
| GB | 1342499 | | 1/1974 | |
| GB | 1342500 | | 1/1974 | B01J/11/46 |
| GB | 1381004 | | 1/1975 | C10G/34/00 |
| GB | 1440230 | | 6/1976 | C10G/34/00 |
| GB | 1460476 | | 1/1977 | B26F/1/02 |
| GB | 1493928 | | 11/1977 | C10G/23/16 |
| GB | 1499570 | | 2/1978 | C10G/34/00 |
| JP | 49035323 | | 4/1974 | |
| JP | 2301561 | | 12/1990 | C23C/14/34 |
| JP | 2302561 | | 10/1991 | |
| JP | H3-231990 | | 10/1991 | |
| JP | 7310096 | | 11/1995 | B08B/1/00 |
| JP | 6200262 | | 1/2000 | C10G/45/50 |
| WO | 92/01769 | | 2/1992 | C10G/73/38 |
| WO | 92/02601 | | 2/1992 | C10L/5/00 |
| WO | 92/14804 | | 9/1992 | C10L/1/08 |
| WO | 94/17160 | | 8/1994 | C10L/1/18 |
| WO | 94/20593 | | 9/1994 | C10L/1/22 |
| WO | 94/28095 | | 12/1994 | C10M/135/18 |
| WO | 95/02695 | | 1/1995 | |
| WO | 95/03377 | | 2/1995 | C10L/1/14 |
| WO | 95/06695 | | 3/1995 | |
| WO | 95/27021 | | 10/1995 | |
| WO | 96/23855 | | 8/1996 | C10L/1/14 |
| WO | 96/26996 | | 9/1996 | C10M/133/08 |
| WO | 97/03750 | | 2/1997 | |
| WO | 97/04044 | | 2/1997 | C10L/1/18 |
| WO | 97/14768 | | 4/1997 | C10L/1/02 |
| WO | 97/14769 | | 4/1997 | C10L/1/08 |
| WO | 97/21787 | | 6/1997 | |

OTHER PUBLICATIONS

Morgan et al, "Some Comparative Chemical, Physical and Compatibility Properties of Sasol Slurry Phase Distillate Diesel Fuel", SAE No. 982488 (1988), pp. 1–9.

Agee, "A New Horizon for Synthetic Fuels", World Conference on Transportation Fuel Quality Oct. 6–8, 1996.

Norton et al, "Emissions from Trucks using Fischer–Tropsch Diesel Fuel", SAE No. 982526, pp. 1–10 (1998).

Booth et al (Shell) "Severe hydrotreating of diesel can cause fuel–injector pump failure", PennWell Publishing Company, Oil & Gas Journal (Aug. 16, 1993).

The Clean Fuels Report, "Volvo Demonstrates Benefits of Reformulated Diesel" "Research and Technology", pp. 166–170, Sep. 1995.

The Clean Fuels Report, "Cetane Number is Major Control for Diesel Emissions with Catalyst", pp. 170–173, Sep. 1995.
Signer et al, "European Programme on Emissions, Fuels and Engine Technologies (EPEFE) –Heavy Duty Diesel Study", SAE No. 961074, pp. 1–21, International Sprin Guels & Lubricants Meeting, Michigan, May 6–8, 1996.
Erwin et al, "The Standing of Fischer–Tropsch Diesel in an Assay of Fuel Performance and Emissons", Southwest Research Institute, Contract No. NREL SUB YZ–2–113215–1 (Oct. 26, 1993).
M'Hamdi et al, "Packed Column SFC of Gas Oils", J. High Resol. Chromatogr., vol. 21, pp. 94–102 (Feb. 1998).
Fraile et al, "Experimental Design Optimization of the Separation of the Aromatic Compounds in Petroleum Cuts by Supercricial Fluid Chromatography", Journal of High Resolution Chromatography, vol. 16, pp. 169–174 (Mar. 1993).
Andersson et al, "Characterization of fuels by multi–dimensional supercritical fluid chromatography and supercritical fluid chromatography–maass spectrometry", Journal of Chromatography, 641, pp. 347–355 (1993).
Di Sanzo et al, "Determination of Aromatics in Jet and Diesel Fuels by Supercritical Fluid Chromatography with Flame Ionization Detection (SFC–FID): A Quantitative Study", Journal of Chromatographic Science, vol. 29, Jan. 1991.
Lee et al, "Development of a Supercritical Fluid Chromatographic Method for Determination of Aromatics in Heating Oils and Diesel Fuels", Energy & Fuels, 3, pp. 80–84 (1989), American Chemical Society.
T.L. Ullman, "Effects of Cetane Number, Cetane Improver, Aromatics, and Oxygenates on 1994 Heavy–Duty Diesel Engine Emissions", SAE Paper 941020.
K.B. Spreen, "Effects of Cetane Number, Aromatics, and Oxygenates on Emissions From a 1994 Heavy–Duty Diesel Engine With Exhaust Catalyst", SAE Paper 950250.
T.L. Ullman, "Effects of Cetane Number on Emissions From a Prototype 1998 Heavy–Duty Diesel Engine", SAE Paper 950251.
J. S. Feeley, "Abatement of $NO_x$ from Diesel Engines: Status & Technical Challenges", SAE Paper 950747.
J. Leyrer, "Design Aspects of Lean $NO_x$ Catalysts for Gasoline & Diesel Applications", SAE Paper 952495.
M. Kawanami, "Advanced Catalyst Studies of Diesel $NO_x$ Reduction for On–Highway Trucks",l SAE Paper 950154.
Anderson, "Det. of Ox and Olefin Compd Types by IR . . . ", Analyt. Chem., vol. 20, No. 11 (Nov. 1946), pp. 998–1006.
Bruner, "Syn. Gasoline From Nat. Gas", Ind. & Eng. Chem., vol. 41, No. 11 (1948), pp. 2511–2515.
Bryant, "Impr. Hydroxylamine Meth. for Det. Aldeh. & Ketones . . . ", p. 57 (Jan. 1935).
DuBois, "Det. of Bromine Addition Numbers", Analyt. Chem., vol. 20, No. 7, pp. 624–627 (1948).
Friedel, "Compos. of Synth. Liquid Fuels. I . . . ", JACS 72, pp. 1212–1215 (1950).
Johnston, "Det. of Olefins in Gasoline", Analyt. Chem. 805–812 (1947).
Niederl, "Micromethods of Quantitative Organic Analysis", pp. 263–272, 2nd ed. (J. Wiley & Sons, NY 1942).
Puckett, "Ignition Qualities of HC in the Diesel Fuel Boiling Range" in Information Circular Bureau of Mines 7474 (Jul. 1948).
Smith, "Rapid Det. of Hydroxyl . . . ", p. 61 (Jan. 1935).
Tilton, "Prod. of High Cetane Number Diesel Fuels by Hydrogenation", Ind. & Eng. Chemistry, vol. 40, pp. 1270–1279 (Jul. 1948).
Underwood, "Industrial Synthesis of HC from Hydrogen and Carbon Monoxide", Ind. & Eng. Chemistry, vol. 32, No. 4, pp. 450–454.
Ward, "Superfractionation Studies", Ind. & Eng. Chem. vol. 39, pp. 105–109 (109th ACS meeting).
Wheeler, "Peroxide Formation as a Meas. of Autoxidative Determination", Oil & Soap 7, 87 (1936).
Eilers, "Shell Middle Dist." Cat. Letters 7, 253–270 (1990).
Lanh, J. Cat., 129, 58–66 (1991), Convers. of Cyclohexane . . . .
Rappold, "Industry pushes use of PDC bits . . . ", J. Oil & Gas, Aug. 14, 1995.
Shah et al, USDOE/USDOC NTIS, UOP, Inc., Fischer–Tropsch Wax Characterization and Upgrading –Final Report, DE 88–014638, Jun. 1988 ("UOP").
Signer, The Clean Fuels Report, "Southwest Research Institute Study Delineates the Effect of Diesel Fuel Composition on Emissions", pp. 153–158 (Jun. 1995).
Lacy, "The U.S. Army Scuffing Load Wear Test", Jan. 1, 1994.
Ryland et al, "Cracking Catalyst", Catalysis vol. VII, P. Emmett, ed., Reinhold Publ. NY (1960), pp. 5–9.
Stournas, "Eff. of Fatty Acids . . . ", JAOC S 72 (4) (1995).
W. Li et al, "Group–Type Separation of Diesel Fuels Using Packed Capillary column Supercritical Fluid Chromatography" Anal. Chem., 1995, 67, 647–654.
Jimell Erwin, "Assay of Diesel Fuel Components Properties and Performance", ACS Symposium on Processing & Selectivity of Synthetic Fuels, pp. 1915–1923, Aug. 23–28, 1992.
P. Anderson et al, "Quantitative Hydrocarbon Group Analysis of Gasoline and Diesel Fuel by Supercritical Fluid Chromatography", Journal of Chromatography, 595 (1992), pp. 301–311.
S. Win Lee, "Initial Validation of a New Procedure for Determining Aromatics in Petroleum Distillates", Journal of Liquid Chromotography, 13 (16), pp. 3211–3227, (1990).
B. J. Fuhr et al, "Determination of Aromatic Types in Middle Distillates by Supercritical Fluid Chromatography", LC–GC, vol. 8, No. 10. pp. 800–804 (1990).
S. Win Lee, "Investigation of Methods for Determining Aromatic Structural Component Information in Middle Distillate Fuels", 196th ACS Nat'l Meet, ACS Div. Fuel Chem. Prepr., vol. 33, No. 4, pp. 883–890 (1988).
P. Sohar, "Nuclear Magnetic Resonance Spectroscopy", vol. II, pp. 92–102, CRC Press (1983).
Alan Goldup et al, "Determination of Trace Quantities of Water in Hydrocarbons", Analytical Chemistry, vol. 38, No. 12, pp. 1657–1661, Nov. 1996.
Lacey, Paul I., "Wear Mechanism Evaluation and Measurement in Fuel Lubricated Components", U.S. Dept. of Commerce #FDA 284870, Sep. 1984.
SwR1 Gear Oil Scuff Test (GOST) Flyer, Gear Oil Scuff Test (GOST), Feb. 1997.

* cited by examiner

SYNTHETIC JET FUEL AND PROCESS FOR ITS PRODUCTION (LAW724)

CROSS REFERENCE TO RELATED APPLICATIONS

This application is a continuation of Ser. No. 09/098,231, now U.S. Pat. No. 6,309,432 which is a continuation-in-part application of Ser. No. 08/798,378, filed Feb. 7, 1997, now U.S. Pat. No. 5,766,274.

FIELD OF THE INVENTION

This invention relates to a distillate material having excellent suitability as a jet fuel with high lubricity or as a blending stock therefor, as well as the process for preparing the jet fuel. More particularly, this invention relates to a process for preparing jet fuel from a Fischer-Tropsch wax.

BACKGROUND OF THE INVENTION

Clean distillates streams that contain no or nil sulfur, nitrogen, or aromatics, are, or will likely be in great demand as jet fuel or in blending jet fuel. Clean distillates having relatively high lubricity and stability are particularly valuable. Typical petroleum derived distillates are not clean, in that they typically contain significant amounts of sulfur, nitrogen, and aromatics. In addition, the severe hydrotreating needed to produce fuels of sufficient stability often results in a fuel with poor lubricity characteristics. These petroleum derived clean distillates produced through severe hydrotreating involve significantly greater expense than unhydrotreated fuels. Fuel lubricity, required for the efficient operation of the fuel delivery system, can be improved by the use of approved additive packages. The production of clean, high cetane number distillates from Fischer-Tropsch waxes has been discussed in the open literature, but the processes disclosed for preparing such distillates also leave the distillate lacking in one or more important properties, e.g., lubricity. The Fischer-Tropsch distillates disclosed, therefore, require blending with other less desirable stocks or the use of costly additives. These earlier schemes disclose hydrotreating the total Fischer-Tropsch product, including the entire 700° F.– fraction. This hydro-treating results in the complete elimination of oxygenates from the jet fuel.

By virtue of this present invention small amounts of oxygenates are retained, the resulting product having high lubricity. This product is useful as a jet fuel as such, or as a blending stock for preparing jet fuels from other lower grade material.

SUMMARY OF THE INVENTION

In accordance with this invention, a clean distillate useful as a jet fuel or as a jet fuel blend stock and having lubricity, as measured by the Ball on Cylinder (BOCLE) test, approximately equivalent to, or better than, the high lubricity reference fuel is produced, preferably from a Fischer-Tropsch wax and preferably derived from cobalt or ruthenium catalysts, by separating the waxy product into a heavier fraction and a lighter fraction; the nominal separation being, for example, at about 700° F. Thus, the heavier fraction contains primarily 700° F.+, and the lighter fraction contains primarily 700° F.–.

The distillate is produced by further separating the lighter fraction into at least two other fractions: (i) one of which contains primary $C_{7-12}$ alcohols and (ii) one of which does not contain such alcohols. The fraction (ii) is a 550° F.+ fraction, preferably a 500° F.+ fraction, more preferably a 475° F.+ fraction, and still more preferably a n-$C_{14}$+ fraction. At least a portion, preferably the whole of this heavier fraction (ii), is subjected to hydroconversion (e.g., hydroisomerization) in the presence of a bi-functional catalyst at typical hydroisomerization conditions. The hydroisomerization of this fraction may occur separately or in the same reaction zone as the hydroisomerization of the Fischer-Tropsch wax (i.e., the heavier 700° F.+ fraction obtained from the Fischer-Tropsch reaction) preferably in the same zone. In any event, a portion of the, for example, 475° F.+ material is converted to a lower boiling fraction, e.g., 475° F.– material. Subsequently, at least a portion and preferably all of the material compatible with jet freeze from hydroisomerization is combined with at least a portion and preferably all of the fraction (i) which is preferably a 250–475° F. fraction, and is further preferably characterized by the absence of any hydroprocessing, e.g., hydroisomerization. The jet fuel or jet fuel blending component of this invention boils in the range of jet fuels and may contain hydrocarbon materials boiling above the jet fuel range to the extent that these additional materials are compatible with the jet freeze specification, i.e., –47° C. or lower. The amount of these so-called compatible materials depends on the degree of conversion in the hydroisomerization zone, with more hydroisomerization leading to more of the compatible materials, i.e., more highly branched materials. Thus, the jet fuel range is nominally 250–550° F., preferably 250–500° F., more preferably 250–475° F. and may include the compatible materials, and having the properties described below.

The jet material recovered from the fractionator has the properties shown in the following table:

| | |
|---|---|
| paraffins | at least 95 wt %, preferably at least 96 wt %, more preferably at least 97 wt %, still more preferably at least 98 wt % |
| iso/normal ratio | about 0.3 to 3.0, preferably 0.7–2.0 |
| sulfur | ≦50 ppm (wt), preferably nil |
| nitrogen | ≦50 ppm (wt), preferably ≦20 ppm, more preferably nil |
| unsaturates (olefins and aromatics) | ≦2.0 wt %, preferably ≦1.0 wt %, most preferably ≦0.5 wt % |
| oxygenates | about 0.005 to less than about 0.5 wt % oxygen, water free basis |

The iso-paraffins are normally mono-methyl branched, and since the process utilizes Fischer-Tropsch wax, the product contains nil cyclic paraffins, e.g., no cyclohexane.

The oxygenates are contained essentially, e.g., ≧95% of oxygenates, in the lighter fraction, e.g., the 250–475° F. fraction, and are primarily, e.g., ≧95%, terminal, linear alcohols of $C_6$ to $C_{12}$.

DESCRIPTION OF PREFERRED EMBODIMENTS

Figure 1:
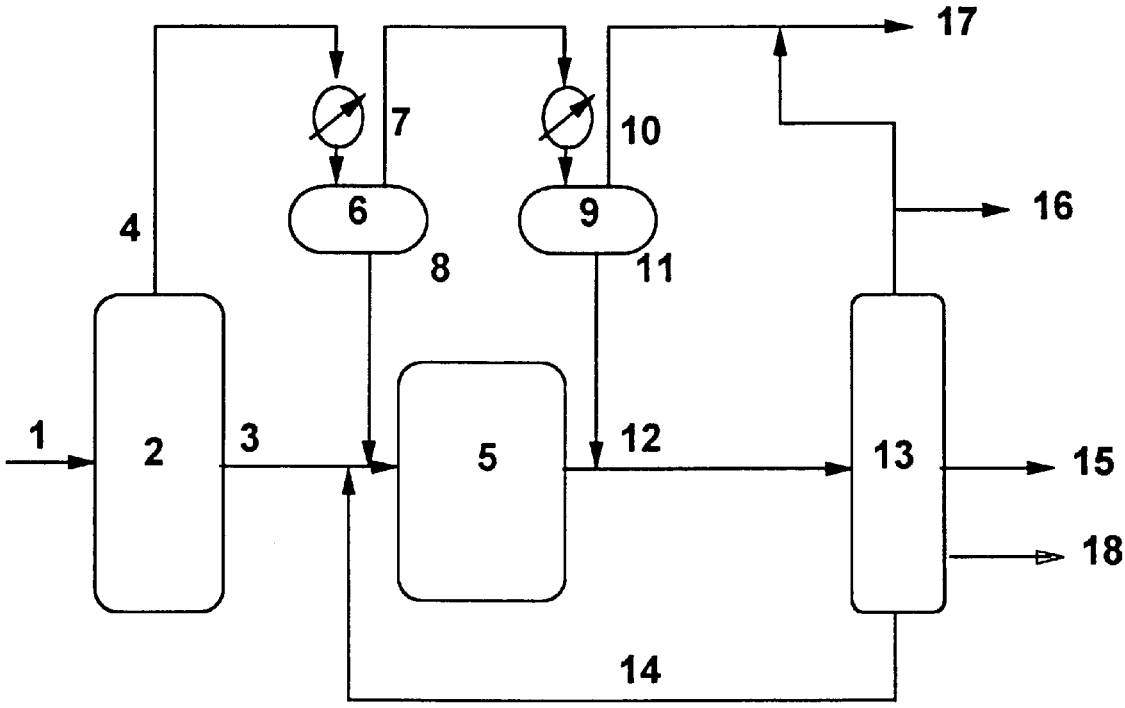
FIG. 1 is a schematic of a process in accordance with this invention.

A more detailed description of this invention may be had by referring to the drawing. Synthesis gas, hydrogen and carbon monoxide, in an appropriate ratio, contained in line 1 is fed to a Fischer-Tropsch reactor 2, preferably a slurry reactor and product is recovered in lines 3 and 4, 700° F.+ and 700° F.– respectively. The lighter fraction goes through a hot separator 6 and a 475–700° F. fraction is recovered in line 8, while a 475° F.– fraction is recovered in line 7. The 475–700° F. fraction is then recombined with the 700+° F. material from line 3 and fed into the hydroisomerization reactor where a percentage, typically about 50%, is converted to 700° F.– material. The 475° F.– material goes through cold separator 9 from which $C_4$- gases are recovered in line 10. A $C_5$-475° F. fraction is recovered in line 11 and is combined with the output from the hydroisomerization reactor, 5, in line 12.

Line 12 is sent to a distillation tower where a $C_4$-250° F. naphtha stream line 16, a 250–475° F. jet fuel line 15, a 475–700° F. diesel fuel line 18, and a 700° F.+ material is produced. The 700° F.+ material may be recycled back to the hydroisomerization reactor 5 or used as to prepare high quality lube base oils. Preferably, the split between lines 15 and 18 is adjusted upwards from 475° F. if the hydroisomerization reactor, 5, converts essentially all of the n-$C_{14}$+ paraffins to isoparaffins. This cut point is preferably 500° F., most preferably 550° F., as long as jet freeze point is preserved at least at −47° C.

The hydroisomerization process is well known and the table below lists some broad and preferred conditions for this step.

| Condition | Broad Range | Preferred Range |
|---|---|---|
| temperature, ° F. | 300–800 | 500–750 |
| total pressure, psig | 300–2500 | 500–1500 |
| hydrogen treat rate, SCF/B | 500–5000 | 1500–4000 |

While virtually any bi-functional catalysts consisting of metal hydrogenation component and an acidic component useful in hydroprocessing (e.g., hydroisomerization or selective hydrocracking) may be satisfactory for this step, some catalysts perform better than others and are preferred. For example, catalysts containing a supported Group VIII noble metal (e.g., platinum or palladium) are useful as are catalysts containing one or more Group VIII non-noble metals (e.g., nickel, cobalt) in amounts of 0.5–20 wt %, which may or may not also include a Group VI metals (e.g., molybdenum) in amounts of 1.0–20 wt %. The support for the metals can be any refractory oxide or zeolite or mixtures thereof. Preferred supports include silica, alumina, silica-alumina, silica-alumina phosphates, titania, zirconia, vanadia and other Group III, IV, VA or VI oxides, as well as Y sieves, such as ultrastable Y sieves. Preferred supports include alumina and silica-alumina.

A preferred catalyst has a surface area in the range of about 200–500 $m^2$/gm, preferably 0.35 to 0.80 ml/gm, as determined by water adsorption, and a bulk density of about 0.5–1.0 g/ml.

This catalyst comprises a non-noble Group VIII metal, e.g., iron, nickel, in conjunction with a Group IB metal, e.g., copper, supported on an acidic support. The support is preferably an amorphous silica-alumina where the alumina is present in amounts of less than about 50 wt %, preferably 5–30 wt %, more preferably 10–20 wt %. Also, the support may contain small amounts, e.g., 20–30 wt %, of a binder, e.g., alumina, silica, Group IVA metal oxides, and various types of clays, magnesia, etc., preferably alumina.

The preparation of amorphous silica-alumina microspheres has been described in Ryland, Lloyd B., Tamele, M. W., and Wilson, J. N., Cracking Catalysts, Catalysis: volume VII, Ed. Paul H. Emmett, Reinhold Publishing Corporation, New York, 1960, pp. 5–9.

The catalyst is prepared by co-impregnating the metals from solutions onto the support, drying at 100–150° C., and calcining in air at 200–550° C.

The Group VIII metal is present in amounts of about 15 wt % or less, preferably 1–12 wt %, while the Group IB metal is usually present in lesser amounts, e.g., 1:2 to about 1:20 ratio respecting the Group VIII metal. A typical catalyst is shown below:

| | |
|---|---|
| Ni, wt % | 2.5–3.5 |
| Cu, wt % | 0.25–0.35 |
| $Al_2O_3$—$SiO_2$ | 65–75 |
| Surface Area | 290–325 $m^2$/gm |
| Pore Volume (Hg) | 0.35–0.45 mL/gm |
| Bulk Density | 0.58–0.68 g/mL |

The 700° F.+ conversion to 700° F.− ranges from about 20–80%, preferably 20–70%, more preferably about 30–60%. During hydroisomerization, essentially all olefins and oxygen containing materials are hydrogenated. In addition, most linear paraffins are isomerized or cracked, resulting in a large improvement in cold temperature properties such as jet freeze point.

The separation of the 700° F.− stream into a $C_5$–475° F. stream and a 475–700° F. stream and the hydroisomerization of 475–700° F. stream leads, as mentioned, to improved freeze point in the product. Additionally, however, the oxygen containing compounds in the $C_5$–475° F. have the effect of improving the lubricity of the resulting jet fuel, and can improve the lubricity of conventionally produced jet fuels when used as a blending stock.

The preferred Fischer-Tropsch process is one that utilizes a non-shifting (that is, no water gas shift capability) catalyst, such as cobalt or ruthenium or mixtures thereof, preferably cobalt, and preferably a promoted cobalt, the promoter being zirconium or rhenium, preferably rhenium. Such catalysts are well known and a preferred catalyst is described in U.S. Pat. No. 4,568,663 as well as European Patent 0 266 898.

The products of the Fischer-Tropsch process are primarily paraffinic hydrocarbons. Ruthenium produces paraffins primarily boiling in the distillate range, i.e., $C_{10}$–$C_{20}$; while cobalt catalysts generally produce more of heavier hydrocarbons, e.g., $C_{20}$+, and cobalt is a preferred Fischer-Tropsch catalytic metal.

Good jet fuels generally have the properties of high smoke point, low freeze point, high lubricity, oxidative stability, and physical properties compatible with jet fuel specifications.

The product of this invention can be used as a jet fuel, per se, or blended with other less desirable petroleum or hydrocarbon containing feeds of about the same boiling range. When used as a blend, the product of this invention can be used in relatively minor amounts, e.g., 10% or more, for significantly improving the final blended jet product. Although, the product of this invention will improve almost any jet product, it is especially desirable to blend this product with refinery jet streams of low quality, particularly those with high aromatic contents.

By virtue of using the Fischer-Tropsch process, the recovered distillate has essentially nil sulfur and nitrogen. These hetero-atom compounds are poisons for Fischer-Tropsch catalysts and are removed from the methane containing natural gas that is a convenient feed for the Fischer-Tropsch process. Sulfur and nitrogen containing compounds are, in any event, in exceedingly low concentrations in natural gas. Further, the process does not make aromatics, or as usually operated, virtually no aromatics are produced. Some olefins are produced since one of the proposed pathways for the production of paraffins is through an olefinic intermediate. Nevertheless, olefin concentration is usually quite low.

Oxygenated compounds including alcohols and some acids are produced during Fischer-Tropsch processing, but in at least one well known process, oxygenates and unsaturates are completely eliminated from the product by hydrotreating. See, for example, the Shell Middle Distillate Process, Eiler, J., Posthuma, S. A., Sie, S. T., Catalysis Letters, 1990, 7, 253–270.

We have found, however, that small amounts of oxygenates, preferably alcohols, provide exceptional lubricity for jet fuels. For example, as illustrations will show, a highly paraffinic jet fuel with small amounts of oxygenates has excellent lubricity as shown by the BOCLE test (ball on cylinder lubricity evaluator). However, when the oxygenates were not present, for example, by extraction, absorption over molecular sieves, hydroprocessing, etc., to a level of less than 10 ppm wt oxygen (water free basis) in the fraction being tested, the lubricity was quite poor.

By virtue of the processing scheme disclosed in this invention a part of the lighter, 700° F.– fraction, i.e., the 250° F.–475° F. fraction is not subjected to any hydrotreating. In the absence of hydrotreating of this fraction, the small amount of oxygenates, primarily linear alcohols, in this fraction are preserved, while oxygenates in the heavier fraction are eliminated during the hydroisomerization step. The valuable oxygen containing compounds, for lubricity purposes, are $C_{7+}$, preferably $C_7$–$C_{12}$, and more preferably $C_9$–$C_{12}$ primary alcohols are in the untreated 250–475° F. fraction. Hydroisomerization also serves to increase the amount of iso-paraffins in the distillate fuel and helps the fuel to meet freeze point specifications.

The oxygen compounds that are believed to promote lubricity may be described as having a hydrogen bonding energy greater than the bonding energy of hydrocarbons (these energy measurements for various compounds are available in standard references); the greater the difference, the greater the lubricity effect. The oxygen compounds also have a lipophilic end and a hydrophilic end to allow wetting of the fuel.

While acids are oxygen containing compounds, acids are corrosive and are produced in quite small amounts during Fischer-Tropsch processing at non-shift conditions. Acids are also di-oxygenates as opposed to the preferred mono-oxygenates illustrated by the linear alcohols. Thus, di- or poly-oxygenates are usually undetectable by infra red measurements and are, e.g., less than about 15 wppm oxygen as oxygen.

Non-shifting Fischer-Tropsch reactions are well known to those skilled in the art and may be characterized by conditions that minimize the formation of $CO_2$ by products. These conditions can be achieved by a variety of methods, including one or more of the following: operating at relatively low CO partial pressures, that is, operating at hydrogen to CO ratios of at least about 1.7/1, preferably about 1.7/1 to about 2.5/1, more preferably at least about 1.9/1, and in the range 1.9/1 to about 2.3/1, all with an alpha of at least about 0.88, preferably at least about 0.91; temperatures of about 175–225° C., preferably 180–220° C.; using catalysts comprising cobalt or ruthenium as the primary Fischer-Tropsch catalysis agent.

The amount of oxygenates present, as oxygen on a water free basis is relatively small to achieve the desired lubricity, i.e., at least about 0.01 wt % oxygen (water free basis), preferably 0.01–0.5 wt % oxygen (water free basis), more preferably 0.02–0.3 wt % oxygen (water free basis).

The following examples will serve to illustrate, but not limit this invention.

Hydrogen and carbon monoxide synthesis gas ($H_2$:CO 2.11–2.16) were converted to heavy paraffins in a slurry Fischer-Tropsch reactor. The catalyst utilized for the Fischer-Tropsch reaction was a titania supported cobalt/rhenium catalyst previously described in U.S. Pat. No. 4,568,663. The reaction conditions were 422–428° F., 287–289 psig, and a linear velocity of 12 to 17.5 cm/sec. The alpha of the Fischer-Tropsch synthesis step was 0.92. The paraffinic Fischer-Tropsch product was then isolated in three nominally different boiling streams, separated utilizing a rough flash. The three approximate boiling fractions were: 1) the $C_5$-500° F. boiling fraction, designated below as F–T Cold separator Liquids; 2) the 500–700° F. boiling fraction designated below as F–T Hot Separator Liquids; and 3) the 700° F.+ boiling fraction designated below at F–T Reactor Wax.

EXAMPLE 1

Seventy wt % of a Hydroisomerized F–T Reactor Wax, 16.8 wt % Hydrotreated F–T Cold Separator Liquids and 13.2 wt % Hydrotreated F–T Hot Separator Liquids were combined and rigorously mixed. Jet Fuel A was the 250–475° F. boiling fraction of this blend, as isolated by distillation, and was prepared as follows: the hydroisomerized F–T Reactor Wax was prepared in flow through, fixed bed unit using a cobalt and molybdenum promoted amorphous silica-alumina catalyst, as described in U.S. Pat. No. 5,292,989 and U.S. Pat. No. 5,378,348. Hydroisomerization conditions were 708° F., 750 psig $H_2$, 2500 SCF/B $H_2$, and a liquid hourly space velocity (LHSV) of 0.7–0.8. Hydrotreated F–T Cold and Hot Separator Liquid were prepared using a flow through fixed bed reactor and commercial massive nickel catalyst. Hydrotreating conditions were 450° F., 430 psig $H_2$, 1000 SCF/B $H_2$, and 3.0 LHSV. Fuel A is representative of a typical of a completely hydrotreated cobalt derived Fischer-Tropsch jet fuel, well known in the art.

EXAMPLE 2

Seventy Eight wt % of a Hydroisomerized F–T Reactor Wax, 12 wt % Unhydrotreated F–T Cold Separator Liquids, and 10 wt % F–T Hot Separator Liquids were combined and mixed. Jet Fuel B was the 250–475° F. boiling fraction of this blend, as isolated by distillation, and was prepared as follows: the Hydroisomerized F–T Reactor Wax was prepared in flow through, fixed bed unit using a cobalt and molybdenum promoted amorphous silica-alumina catalyst, as described in U.S. Pat. No. 5,292,989 and U.S. Pat. No. 5,378,348. Hydroisomerization conditions were 690° F., 725 psig $H_2$, 2500 SCF/B $H_2$, and a liquid hourly space velocity (LHSV) of 0.6–0.7. Fuel B is a representative example of this invention.

EXAMPLE 3

To measure the lubricity of this invention against commercial jet fuel in use today, and its effect in blends with commercial jet fuel the following fuels were tested. Fuel C is a commercially obtained U. S. Jet fuel meeting commercial jet fuel specifications which has been treated by passing it over adapulgous clay to remove impurities. Fuel D is a mixture of 40% Fuel A (Hydrotreated F–T Jet) and 60% of Fuel C (U.S. Commercial Jet). Fuel E is a mixture of 40% Fuel B (this invention) and 60% of Fuel C (US Commercial Jet).

EXAMPLE 4

Fuel A from Example 1 was additized with model compound alcohols found in Fuel B of this invention as follows: Fuel F is Fuel A with 0.5% by weight of 1-Heptanol. Fuel G is Fuel A with 0.5% by weight of 1-Dodecanol. Fuel H is Fuel A with 0.05% by weight of 1-Hexadecanol. Fuel I is Fuel A with 0.2% by weight of 1-Hexadecanol. Fuel J is Fuel A with 0.5% by weight of 1-Hexadecanol.

EXAMPLE 5

Jet Fuels A–E were all tested using a standard Scuffing Load Ball on Cylinder Lubricity Evaluation (BOCLE or SLBOCLE), further described as Lacey, P. I. "The U.S.

Army Scuffing Load Wear Test" , Jan. 1, 1994. This test is based on ASTM D 5001. Results are reported in Table 2 as percents of Reference Fuel 2, described in Lacey, and in absolute grams of load to scuffing.

TABLE 1

Scuffing BOCLE results for Fuels A–E. Results reported as absolute scuffing loads and percents of Reference Fuel 2 as described in the above reference.

| Jet Fuel | Scuffing Load | % Reference Fuel 2 |
|---|---|---|
| A | 1300 | 19% |
| B | 2100 | 34% |
| C | 1600 | 23% |
| D | 1400 | 21% |
| E | 2100 | 33% |

The completely hydrotreated Jet Fuel A, exhibits very low lubricity typical of an all paraffin jet fuel. Jet Fuel B, which contains a high level of oxygenates as linear, $C_5$–$C_{14}$ primary alcohols, exhibits significantly superior lubricity properties. Jet fuel C, which is a commercially obtained U.S. Jet Fuel exhibits slightly better lubricity than Fuel A, but is not equivalent to fuel B of this invention. Fuels D and E show the effects of blending Fuel B of this invention. For Fuel D, the low lubricity Fuel A combined with Fuel C, produces a Fuel with lubricity between the two components as expected, and significantly poorer than the F–T fuel of this invention. By adding Fuel B to Fuel C as in Fuel E, lubricity of the poorer commercial fuel is improved to the same level as Fuel B, even though Fuel B is only 40% of the final mixture. This demonstrates the substantial improvement which can be obtained through blending the fuel of this invention with conventional jet fuels and jet fuel components.

EXAMPLE 7

An additional demonstration of the effect of the alcohols on lubricity is shown by adding specific alcohols back to Fuel A with low lubricity. The alcohols added are typical of the products of the Fischer-Tropsch processes described in this invention and found in Fuel B.

TABLE 2

Scuffing BOCLE results for Fuels A and F–J. Results reported as absolute scuffing loads and percents of Reference Fuel 2 as described the above reference.

| Jet Fuel | Scuffing Load | % Reference Fuel 2 |
|---|---|---|
| A | 1300 | 19% |
| F | 2000 | 33% |
| G | 2000 | 33% |
| H | 2000 | 32% |
| I | 2300 | 37% |
| J | 2700 | 44% |

EXAMPLE 8

Fuels from Examples 1–5 were tested in the ASTM D5001 BOCLE test procedure for aviation fuels. This test measures the wear scar on the ball in millimeters as opposed to the scuffing load as shown in Examples 6 and 7. Results for this test are show for Fuels A, B, C, E, H, and J which demonstrate that the results from the scuffing load test are similarly found in the ASTM D5001 BOCLE test.

TABLE 3

ASTM D5001 BOCLE results for Fuels A, B, C, E, H, J. Results reported as wear scar diameters as described in ASTM D5001

| Jet Fuel | Wear Scar Diameter |
|---|---|
| A | 0.57 mm |
| B | 0.54 mm |
| C | 0.66 mm |
| E | 0.53 mm |
| H | 0.57 mm |
| J | 0.54 mm |

Results above show that the fuel of this invention, Fuel B, shows superior performance to either the commercial jet fuel, Fuel C, or the hydrotreated Fischer-Tropsch fuel, Fuel A. Blending the poor lubricity commercial Fuel C with Fuel B results in performance equivalent to Fuel B as was found in the Scuffing Load BOCLE test. Adding very small amounts of alcohols to Fuel A does not improve lubricity in this test as it did in the scuffing load test (Fuel H), but at higher concentration improvement is seen (Fuel J).

What is claimed is:

1. A material useful as a jet fuel or as a blending component for a jet fuel comprising: a 250–550° F. fraction derived from a non-shifting Fischer-Tropsch process, said material including at least 95 wt % paraffins with an iso to normal ratio of about 0.7 to 2.0, ≦50 ppm (wt) each of sulfur ≦20 ppm (wt) of nitrogen less than about 0.5 wt % unsaturates, ≦0.5 wt % olefins and aromatics, and about 0.02–0.3 wt % oxygen, water free basis.

2. The material of claim 1 wherein the oxygen is ≧95%, terminal, linear alcohols of $C_6$ to $C_{12}$.

3. The material of claim 2 wherein the oxygen is ≧95%, $C_9$–$C_{12}$ primary alcohols.

4. The material of claim 1 wherein the oxygen containing compounds in the $C_5$–475° F. have the effect of improving the lubricity of the resulting jet fuel.

5. The material of claim 1 wherein the material has a jet-freeze specification of −47° C. or lower.

6. A method for improving jet fuel freeze point by separating a 700° F.- Fischer Tropsch stream into a $C_5$–475° F. stream, and hydroisomerizing the 475–700° F. stream.

7. A method for improving jet fuel lubricity by adding a blending stock with at least 10 ppm (wt) linear alcohols, on an oxygen weight basis.

* * * * *